US006532910B2

(12) United States Patent
Langervik

(10) Patent No.: US 6,532,910 B2
(45) Date of Patent: Mar. 18, 2003

(54) ENGINE COOLING SYSTEM

(75) Inventor: Dennis Langervik, Greensboro, NC (US)

(73) Assignee: Volvo Trucks North America, Inc., Greensboro, NC (US)

( * ) Notice: Subject to any disclaimer, the term of this patent is extended or adjusted under 35 U.S.C. 154(b) by 0 days.

(21) Appl. No.: 09/788,874

(22) Filed: Feb. 20, 2001

(65) Prior Publication Data

US 2002/0112678 A1 Aug. 22, 2002

(51) Int. Cl.[7] ..... F01P 7/14; F01P 3/22
(52) U.S. Cl. ..... 123/41.08; 123/41.54
(58) Field of Search ..... 123/41.08, 41.54, 123/559.1, 41.09, 41.1; 137/480, 517, 519.5

(56) References Cited

U.S. PATENT DOCUMENTS

| | | | | | |
|---|---|---|---|---|---|
| 2,191,611 | A | * | 2/1940 | Eshbaugh et al. | 123/41.1 |
| 3,162,182 | A | * | 12/1964 | Gratzmuller | 123/41.08 |
| 3,256,868 | A | | 6/1966 | Gratzmuller | 123/41.54 |
| 3,576,181 | A | * | 4/1971 | Neal et al. | 123/41.51 |
| 4,478,178 | A | * | 10/1984 | Pernet | 123/41.01 |
| 4,565,162 | A | | 1/1986 | Seki et al. | 123/41.08 |
| 4,608,827 | A | * | 9/1986 | Hasegawa et al. | 123/41.31 |
| 4,640,235 | A | | 2/1987 | Martin | 123/41.08 |
| 4,649,869 | A | | 3/1987 | Hayashi et al. | 123/41.21 |
| 4,669,426 | A | | 6/1987 | Hirano et al. | 123/41.15 |
| 4,722,305 | A | * | 2/1988 | Haskell | 123/41.27 |
| 4,782,689 | A | * | 11/1988 | DeRome | 73/49.2 |
| 4,913,107 | A | | 4/1990 | Schweiger | 123/41.54 |
| 4,928,637 | A | * | 5/1990 | Naitoh et al. | 123/41.31 |
| 4,930,455 | A | | 6/1990 | Creed et al. | 123/41.1 |
| 4,958,600 | A | * | 9/1990 | Janthur | 123/41.31 |
| 5,036,888 | A | | 8/1991 | Scharrer et al. | 138/89 |
| 5,044,430 | A | | 9/1991 | Avrea | 123/41.54 |
| 5,111,777 | A | | 5/1992 | Steinberg et al. | 123/41.54 |
| 5,186,242 | A | * | 2/1993 | Adachi et al. | 165/104.27 |
| 5,241,926 | A | | 9/1993 | Sato et al. | 123/41.54 |
| 5,289,803 | A | | 3/1994 | Matsushiro et al. | 123/41.54 |
| 5,666,911 | A | | 9/1997 | Gohl et al. | 123/41.54 |
| 5,809,944 | A | | 9/1998 | Aoki et al. | 123/41.02 |
| 5,836,269 | A | | 11/1998 | Schneider | 123/41.54 |
| 5,899,266 | A | | 5/1999 | Szucs | 123/41.54 |
| 6,016,774 | A | | 1/2000 | Bokkers et al. | 123/41.1 |
| 6,053,132 | A | | 4/2000 | Evans | 123/41.54 |
| 6,135,067 | A | * | 10/2000 | Klamm et al. | 123/41.01 |
| 6,213,062 | B1 | * | 4/2001 | Kawase | 123/41.31 |
| 6,244,294 | B1 | * | 6/2001 | Hollis | 123/41.27 |

FOREIGN PATENT DOCUMENTS

| | | |
|---|---|---|
| DE | 2222919 | 11/1972 |
| EP | 360252 | 9/1989 |
| EP | 520135 | 2/1992 |
| GB | 2175997 | 5/1986 |
| JP | 63-85215 | 4/1988 |
| JP | 2-294515 | 12/1990 |
| SU | 1211-422 | 7/1984 |
| SU | 1218-160 | 9/1984 |
| SU | 1204757 | 1/1986 |

* cited by examiner

*Primary Examiner*—Henry C. Yuen
*Assistant Examiner*—Hai Huynh
(74) *Attorney, Agent, or Firm*—Watts, Hoffmann, Fisher & Heinke Co.

(57) ABSTRACT

An improved cooling system for a turbo charged internal combustion engine is disclosed. A conduit connects a pressurizing engine air intake to the cooling system to raise the pressure in the cooling system thereby enabling an increase of the maximum temperature which coolant in the cooling system can reach.

28 Claims, 2 Drawing Sheets

ENGINE COOLING SYSTEM

TECHNICAL FIELD

This invention relates to engine cooling systems and more particularly to a novel and improved cooling system in a turbo charged internal combustion engine.

BACKGROUND ART

The development of internal combustion engines for reduced exhaust emissions has resulted in significant increases in the amount of heat dissipation into engine cooling systems. Traditionally, increases in the required amount of heat dissipation has been accomplished by improving the radiator cooling capacity through increasing the core size of the radiator. In addition, increased coolant and cooling air flow has been used to deal with the increase in required heat dissipation.

Packaging space for larger radiator cores and high energy consumption due to increased coolant and cooling air flow limit the amount of heat dissipation capacity increase that can be accomplished with these traditional approaches.

It is possible to improve cooling capacity by elevating the maximum permissible coolant temperature above traditional levels. The adoption of pressurized cooling systems which permitted operation with coolants at 100° C./212° F. was a step in this direction. The addition of expansion tanks assisted in maintaining such temperature levels. However, it has become desirable to elevate coolant temperatures to even higher levels.

Utilization of elevated coolant temperatures requires proper pressurization under all operating, stand-still and ambient conditions in order to control cooling characteristics, secure coolant flow, prevent cavitation and cavitation erosion and to prevent unwanted boiling and overflow.

Temperature and pressure increase becomes more critical as the heat dissipation from the engine approaches the cooling capacity of the cooling system. A now traditional approach for pressurizing cooling systems is to rely on closed expansion or pressure tanks which depend on temperature increases of coolant and air to create and maintain desired pressures. Such a system communicates with ambient air by opening two way pressure valves to thereby communicating the system with ambient air to entrain new air into the pressure tank when entrapped air and the coolant cool to create a vacuum in the system. Such systems are passive and vulnerable to leaks. Moreover, if such a system is depressurized for any reason, such as maintenance or top-off, pressure is reduced to ambient and operating time and cycles are needed to increase the pressure in the system.

SUMMARY OF THE INVENTION

According to the present invention, an internal combustion engine cooling system is pressurized by introducing air under pressure from an external pressurized source. More specifically, in the preferred and disclosed embodiment, air under pressure from an engine intake manifold is communicated into the cooling system thereby to pressurize the system and elevate the maximum available coolant temperature. In its simplest form, a conduit connects an engine intake manifold with a cooling system expansion tank via a flow control check valve. The flow control valve is in the form of a spring loaded non-return valve connected in the conduit for enabling unidirectional flow from the intake manifold to the expansion tank.

In an alternate embodiment, a flow control valve in the form of a spring loaded non-return valve is also used. A second spring loaded non-return valve allows decompression of the expansion tank to a threshold pressure level corresponding to the spring pressure of the second valve plus the pressure in the engine air inlet system. In order to dampen decay of pressure in the coolant system, a restrictor is interposed in series with the second non-return valve.

A further alternative includes an electric or pneumatic switch between the restrictor and the second non-return valve. A control algorithm for this switch is based on coolant pressure, temperature, engine load parameters and duty cycles for optimizing the expansion tank pressure.

In a still further alternative, a two directional two way control valve is used together with pressure sensors respectively located on opposite sides of the control valve. A control algorithm for pressure control is based on selected parameters such as coolant pressure, engine load, charge air pressure, coolant temperature, ambient temperature and pressure, cooling system capacity, cooling fan speed and duty cycles.

The alternate embodiments using electronic control units enable diagnosis of the systems actual functioning condition. The system compares actual pressure levels, time temperatures and valve positions with expected critical pressures under given conditions in the setting and design parameters for the system and components used in it. Diagnostic information is available for drivers and service information. It also can be used for actively changing the functioning of the system to enable continued use of the engine vehicle in a so-called limp home mode in case of system malfunction.

Accordingly, the objects of this invention are to provide a novel and improved engine coolant system and a method of engine cooling.

DESCRIPTION OF THE PREFERRED EMBODIMENTS

Figure 1:
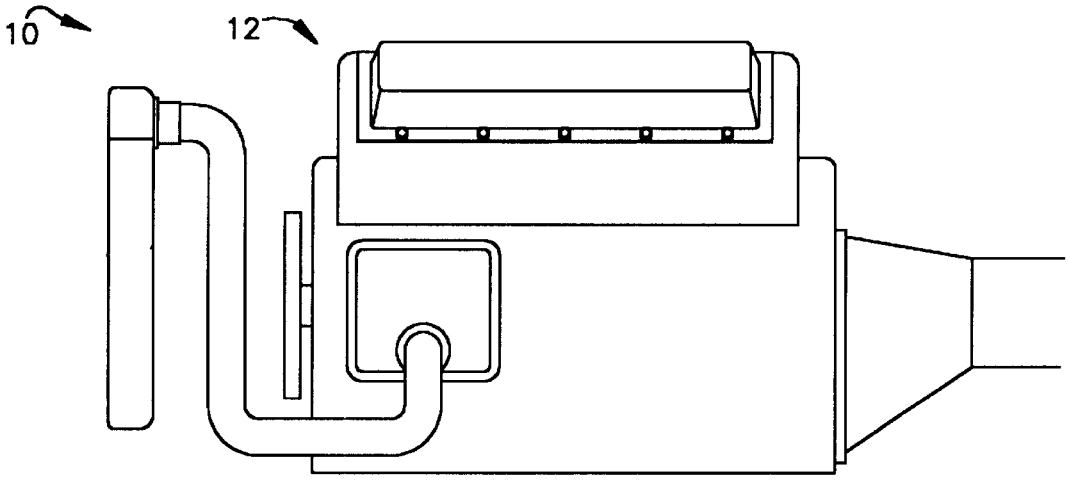
FIG. 1 is a schematic view of an over the highway heavy duty truck or tractor equipped with a turbo charged engine and cooling system made in accordance with the present invention.

Referring to the drawings and FIG. 1 in particular, an over the highway truck or tractor is shown generally at 10. The truck is equipped with a turbo charged engine 12. As shown somewhat schematically in FIG. 2 the engine 12 is equipped with a cylinder head 14 having an air intake manifold 15. The engine 12 is equipped with a turbo charger pressurizing the intake manifold 15 as shown schematically at 16 in FIG. 2.

Figure 2:
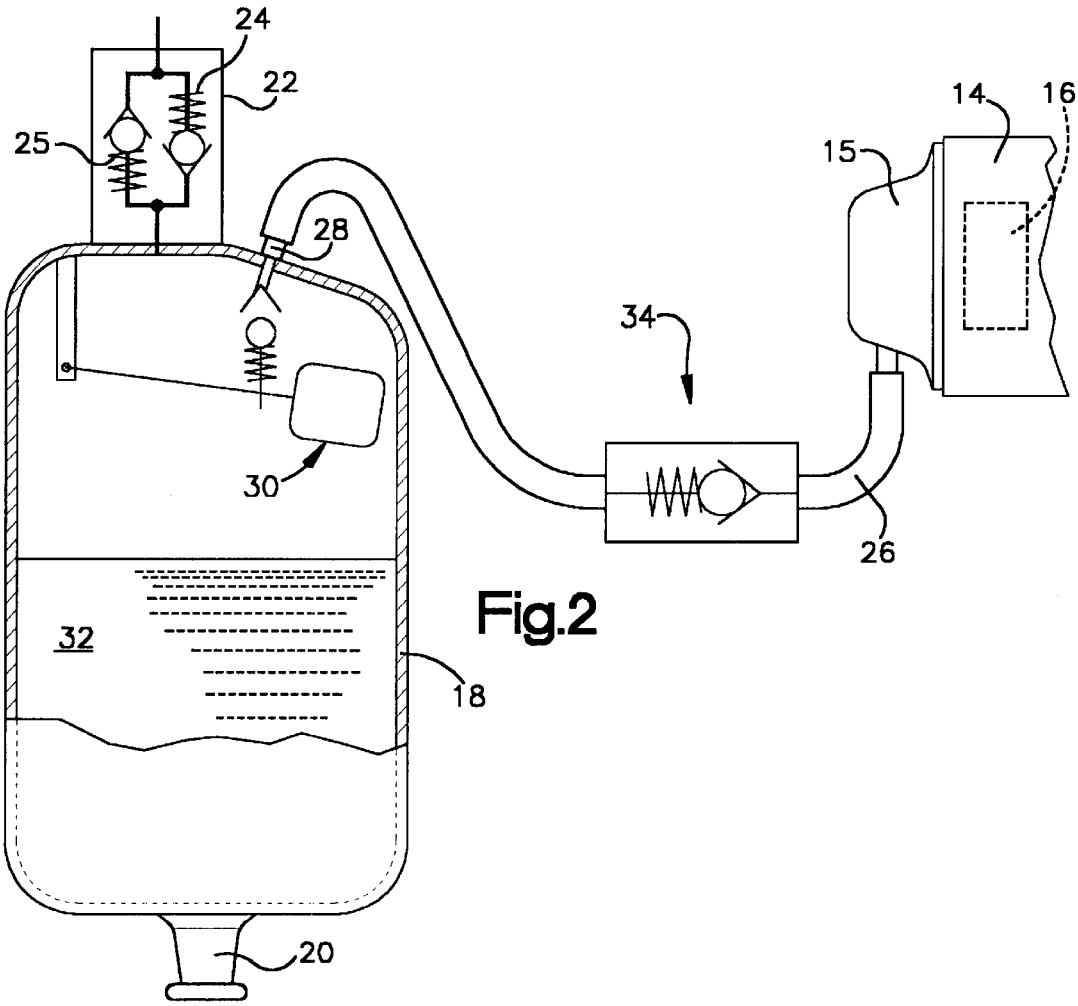
FIG. 2 is a schematic view of one embodiment of the novel portions of the cooling system of the present invention.

The engine 12 is equipped with a cooling system which includes an expansion tank 18, FIG. 2. The expansion tank 18 is a now standard tank including an outlet 20 connected to an inlet of a water or coolant pump. The tank 18 includes a fill opening equipped with a pressure cap 22. In the disclosed embodiment, the cap 22 includes a tank pressure relief and coolant overflow valve 24 and a vacuum relief valve 25 as is now conventional in coolant systems.

A conduit 26 connects the intake manifold 15 to the expansion tank 18. The conduit 26 communicates with the expansion tank 18 through an inlet 28. A floating check valve 30 functions to control unidirectional fluid flow through the inlet 28 when a level of coolant 32 in the tank 18 rises to a higher level than that depicted in FIG. 2. Thus, the check valve 28 functions to prevent coolant 32 from entering the conduit 26.

A flow control valve 34 is interposed in the conduit 26. In its simplest form, the flow control valve is a simple spring loaded non-return valve which allows pressurized flow from the manifold 15 to the tank 18, but prevents reverse flow of pressurized fluid from the tank 18 to the manifold 15.

With the embodiment of FIG. 2, the tank pressure relief valve 24 will control the pressure in the cooling system. So long as the pressure level at which the tank pressure relief valve operates is higher than the pressure in the system, the operating pressure in the system will always be above the opening pressure of the flow control valve and below the tank pressure relief valve's opening pressure due to the one way functioning of the flow control valve 34.

Figure 3:
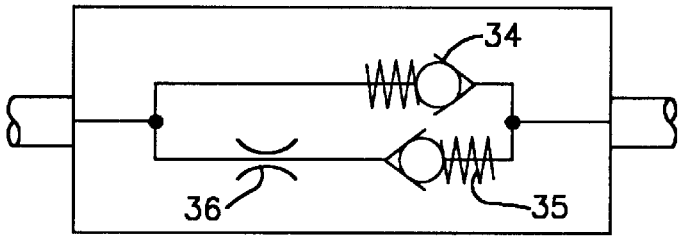
FIG. 3 is a schematic showing of an alternate flow control valve arrangement for the system of FIG. 2.

In the embodiment of FIG. 3, a second valve in the form of another spring loaded non-return valve 35 is provided. The valve 35 allows decompression of the expansion tank pressure down to a threshold pressure level corresponding to the spring pressure of the valve 35 plus the pressure of the engine air inlet system. In order to dampen the pressure decay in the cooling system, a restrictor 36 is in series with the second flow control valve 35. In FIG. 3, the restrictor is shown on the coolant side of the valve but it could be on the engine side.

Figure 4:
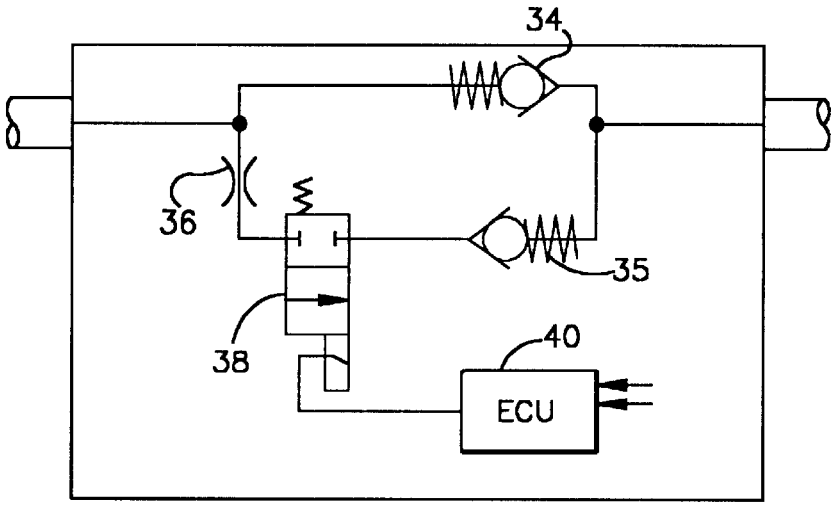
FIG. 4 is a further alternate arrangement of the flow control valving for the system of FIG. 2.

With the embodiment of FIG. 4, a directional control flow valve 38 is added to the system in series with the restrictor 36 and the second or decompression control valve 35. The directional control valve 38 functions to prevent automatic pressure decay in the expansion tank by maintaining a higher pressure when the engine load and the pressure in the engine intake system is reduced.

An electronic control unit 40 controls the positioning of the directional control valve. The control algorithm for this function is based on coolant pressure, temperature, engine load parameters, and duty cycles relevant for optimizing the expansion tank pressure. Alternatively, a pneumatic switch may be substituted for the electrically control directional control valve that has been described.

Figure 5:
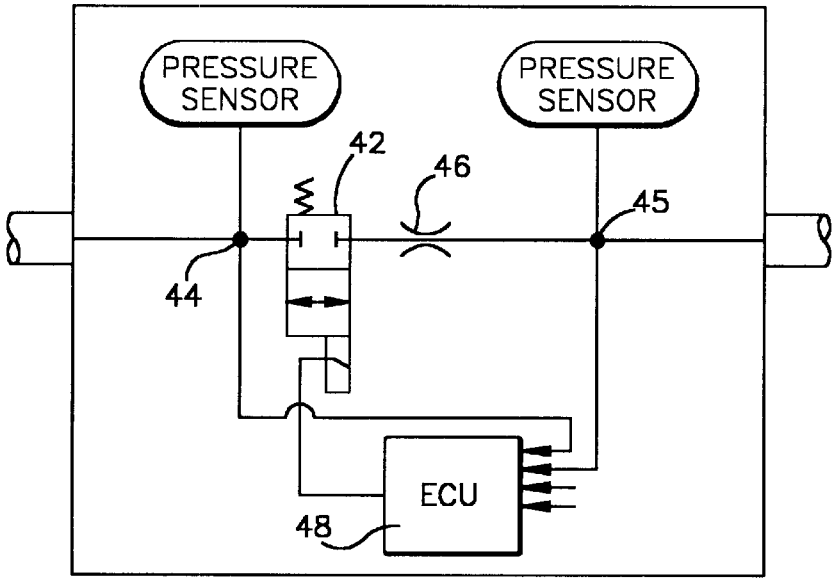
FIG. 5 is a schematic view of yet another alternate flow control valving arrangement for the system of FIG. 2.

FIG. 5 discloses an alternative which offers full flexibility in building up and maintaining pressure in the expansion tank 18 and therefore in the coolant system. The alternate of FIG. 5 includes control of pressure variations and amplitudes. The system of FIG. 5 utilizes a two directional, two way control valve 42. Pressure sensors 44,45 are respectively positioned between the one way valve 42 and the expansion tank 18 and between the one way valve and the engine intake manifold 15. A restrictor 46 is interposed in series with the direction control valve 42 and the pressure sensor 45.

The direction control valve 42 is controlled by an electronic control unit 48. A control algorithm for the control unit 48 is based on selected parameters such as coolant pressure, engine load, charge pressure, coolant temperature, ambient temperature, ambient pressure, cooling system capacity, cooling fan speed, and duty cycles. The pressure in the expansion tank is optimized by actively pressurizing to satisfy coolant system function. While the pressure is optimized, it is only to necessary pressure levels and with pressure variations and amplitudes which match the properties of materials used in the coolant system.

A passive pressure build-up in the expansion tank will take place naturally and in parallel with the active pressure control systems that have been described. How the passive pressure build-up will interact depends on which of the embodiments is employed.

The embodiments of FIGS. 4 and 5 make it possible to diagnose a system's actual functioning condition and to identify problems. Such a system compares actual pressure levels, time, temperatures and valve positions with expected critical pressures under given conditions and the setting of design parameters for the system as well as components used in it.

Diagnostic information derived when either the embodiment of FIGS. 4 or 5 is in use, can be used for driver and service information. It can also be used for actively changing the functioning of the system to enable continued use of the vehicle in a so-called limp home mode in case of an identified system malfunction. Examples of changing functions are modifying valve functions, shutting off the active system pressurizing by the turbo charger, reduction of available engine power and heat dissipation, and altered cooling fan, speed and fan-clutch engagement.

OPERATION

In operation from cold engine start up, operation of the turbo charger will transmit air under pressure through the conduit 26 to the expansion tank 18. Assuming the pressure relief setting of the cap pressure relief valve 24 is high enough, air under pressure will flow through the flow control valve 34 until pressure in the expansion tank 18 is approaching the relief valve opening pressure (but not higher). Should the pressure of air from the turbo charger 16 drop, the one way flow control valve 34 will prevent a pressure drop in the expansion tank 18.

With the embodiment of FIG. 3, the second non-return flow valve 35 functions to reduce the pressure in the coolant system when outlet pressure from the turbo charger is reduced, but not lower than the pre-set opening pressure of the second flow control valve 35.

With the embodiment of FIG. 4, the directional control valve 38 functions to prevent automatic pressure decay in the expansion tank to maintain higher pressure when the engine load and the pressure of the engine intake system is reduced. The electronic control unit 40 of the FIG. 4 embodiment, will function based on the parameters that have been selected to control pressure decay in the coolant system.

With the embodiment of FIG. 4, pressure in the coolant system in relation to pressure in the engine air inlet 15 is totally controlled by the one way directional control valve 42 which in turn is controlled by the electronic control unit 46. This functioning is in accordance with the parameters that have been described.

The embodiment of FIG. 5 is effective to control coolant system pressure appropriate for operating parameters and as such to maximize performance benefits of a pressurized cooling system.

Although the invention has been described in its preferred form with a certain degree of particularity, it is understood that the present disclosure of the preferred form has been made only by way of example and that numerous changes in the details of construction, operation and the combination and arrangement of parts may be resorted to without departing from the spirit and scope of the invention as hereinafter claimed.

In the claims:

1. In a turbo charged engine, an improved cooling system comprising at least one conduit connecting a pressurized engine air intake to an inlet to an expansion tank of the cooling system whereby to raise the pressure in the cooling system and thereby enable an increase of the maximum temperature which coolant in the cooling system can reach and a floating check valve in said tank that prevents said coolant from entering said at least one conduit when a level of said coolant exceeds a predetermined level.

2. The system of claim 1, wherein there is a flow control valve in the conduit.

3. The system of claim 2, wherein the flow control valve is an electronically controlled two directional, two way control valve.

4. The system of claim 2, wherein the conduit is connected to the expansion tank check valve.

5. The system of claim 2, wherein the flow control valve is a spring loaded non-return valve permitting flow of air under pressure to the coolant system.

6. The system of claim 5, wherein a second spring loaded non-return valve is in parallel with the flow control valve to allow decompression of the expansion tank whereby to maintain the pressure in the expansion tank between said maximum and a threshold pressure.

7. The system of claim 6, wherein a directional control valve is connected in series with the second non-return valve.

8. The system of claim 7, wherein there are a pair of pressure sensors connected to said conduit on opposite sides of the flow control valve.

9. In a vehicle having a turbo charged engine equipped with a cooling system, a system for elevating the maximum temperature of coolant in the system, the system comprising:

a) an expansion tank forming a part of the system;

b) the tank having a pressure relief and coolant overflow valve and a vacuum relief valve;

c) the tank also having a floating check valve;

d) a conduit connecting a pressurized air intake manifold of the engine to the check valve, said check valve prevents coolant from entering said at least one conduit when a level of said coolant exceeds a predetermined level; and, e) a flow control valve in the conduit.

10. The system of claim 9, wherein the flow control valve is a spring loaded non-return valve permitting flow of air under pressure to the coolant system.

11. The system of claim 10, wherein a second spring loaded non-return valve is in parallel with the flow control valve to allow decompression of the expansion tank whereby to maintain the pressure in the expansion tank between said maximum and a threshold pressure.

12. The system of claim 11, wherein a directional control valve is connected in series with the second non-return valve.

13. The system of claim 12, wherein there are a pair of pressure sensors connected to said conduit on opposite sides of the flow control valve.

14. The system of claim 9 wherein the engine is a vehicle engine.

15. The system of claim 14 wherein the vehicle is an over the highway heavy duty vehicle.

16. In a powered mechanism including a combustion engine having a liquid cooling system, an arrangement for elevating the available operating temperature of the engine comprising:

a) a source of air under pressure;

b) a conduit connecting the source to an inlet to an expansion tank of the system;

c) a floating check valve in said tank that prevents coolant from entering said conduit when a level of said coolant exceeds a predetermined level.

17. The arrangement of claim 16, wherein the engine includes a turbocharger and the source is an engine air intake.

18. The arrangement of claim 16, wherein the engine is in an over the highway heavy duty vehicle.

19. The arrangement of claim 16, wherein there is a flow control valve in the conduit.

20. The arrangement of claim 19, wherein the flow control valve is a spring loaded non-return valve.

21. The arrangement of claim 19, wherein a second spring loaded non-return valve is in parallel with the flow control valve to allow decompression of the expansion tank whereby to maintain the pressure in the expansion tank between said maximum and a threshold pressure.

22. The arrangement of claim 21, wherein a directional control valve is connected in series with the second non-return valve.

23. A process of improving engine performances with elevated operating temperatures comprising:

a) delivering air under pressure in excess of ambient pressures from a pressurizing source to an engine cooling system;

b) controlling the pressure in the system by delivering the pressurized air via a valve; and, c) preventing coolant from entering said pressurizing source when a level of coolant in the cooling system exceeds a predetermined level.

24. The process of claim 23, wherein the engine is turbo charged and the source is an engine intake manifold.

25. The process of claim 24, wherein the valve is a spring biased one way valve.

26. The process of claim 24, wherein the engine is in a heavy duty over the highway vehicle.

27. The process of claim 23, wherein the valve is a spring biased one way valve.

28. The process of claim 23, wherein the engine is in a heavy duty over the highway vehicle.

* * * * *